United States Patent [19]

Fournier

[11] Patent Number: 4,872,538

[45] Date of Patent: Oct. 10, 1989

[54] ARTICLE OF LUGGAGE OR THE LIKE AND METHOD OF MAKING SAME

[75] Inventor: James L. Fournier, N. Bennington, Vt.

[73] Assignee: JLF Designs, Inc., North Bennington, Vt.

[21] Appl. No.: 161,006

[22] Filed: Feb. 26, 1988

[51] Int. Cl.[4] ..... A45C 3/02; A45C 13/10

[52] U.S. Cl. ..... 190/111; 190/112; 190/119; 190/126; 190/903; 112/265.2; 112/426; 150/117; 150/128; 383/97; 383/107; 383/120

[58] Field of Search ..... 190/119, 901–903, 190/126, 111, 112; 112/426, 265.2; 383/107, 120, 61, 97; 150/128, 117, 114

[56] References Cited

U.S. PATENT DOCUMENTS

| | | | |
|---|---|---|---|
| 2,011,879 | 8/1935 | Stein | 190/901 X |
| 2,107,180 | 2/1938 | Gihon, 3d | 190/119 X |
| 2,359,100 | 9/1944 | Florin | 190/901 X |
| 2,502,275 | 3/1950 | Perlin | 190/901 X |
| 2,539,051 | 1/1951 | Benenfeld | 190/126 |
| 2,581,763 | 1/1952 | Hickler | 190/901 X |
| 2,717,671 | 9/1955 | Arnold et al. | 190/119 |
| 2,781,809 | 2/1957 | Wolf | 190/126 |
| 3,023,794 | 3/1962 | Lifton | 190/901 X |
| 3,333,280 | 8/1967 | Hynek et al. | 2/143 |
| 3,489,194 | 1/1970 | Hoover | 190/901 X |
| 3,768,610 | 10/1973 | Housel | 190/903 X |
| 3,898,943 | 8/1975 | Braden et al. | 112/262 |
| 4,301,849 | 11/1981 | Litwack et al. | 190/903 X |

FOREIGN PATENT DOCUMENTS

| | | | |
|---|---|---|---|
| 514453 | 11/1939 | United Kingdom | 383/120 |

*Primary Examiner*—Sue A. Weaver

[57] ABSTRACT

An article of luggage has first and second side walls joined by a joining wall. In preferred embodiments, the luggage further included a zipper positioned against the inner surface of the first side wall and forming a closure to a pocket of dimension similar to that of the side wall, and the joining wall includes a second zipper or gusset. A method of forming an article of luggage is also described.

24 Claims, 2 Drawing Sheets

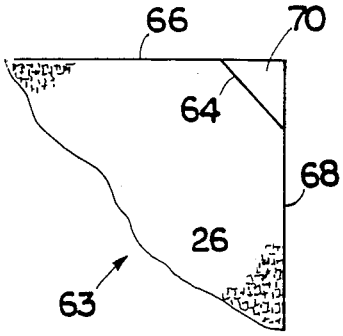
FIG.4
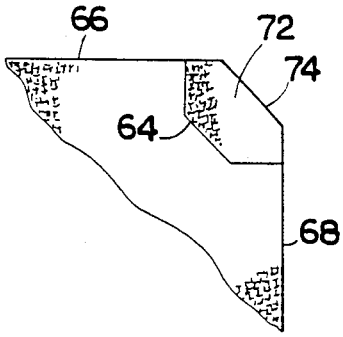
FIG.5
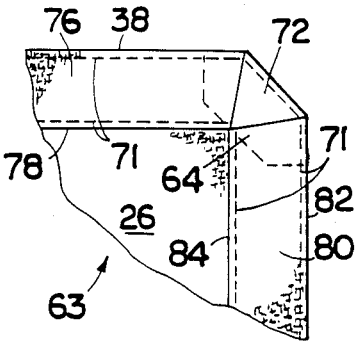
FIG.6
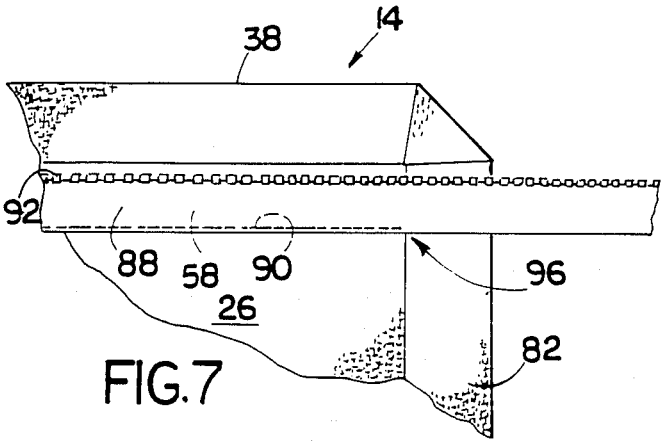
FIG.7
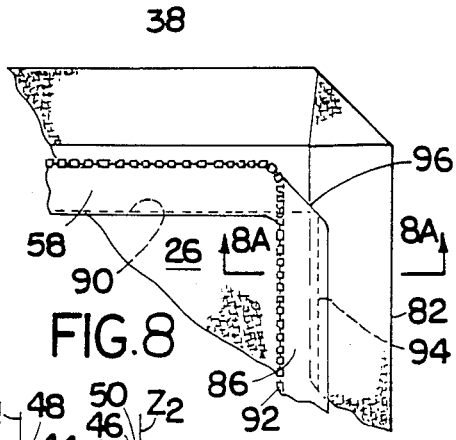
FIG.8
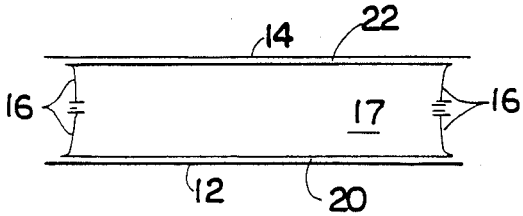
FIG.3A
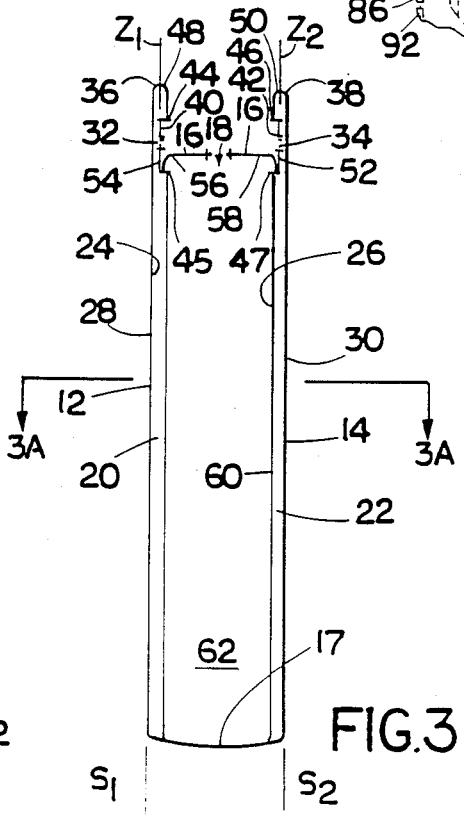
FIG.3
FIG.8A
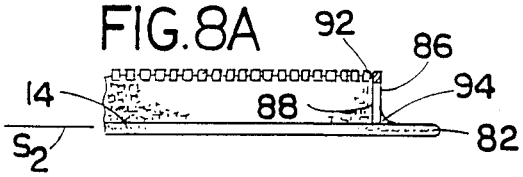

ARTICLE OF LUGGAGE OR THE LIKE AND METHOD OF MAKING SAME

The invention relates to luggage articles formed in part of textile, leather or the like.

SUMMARY OF THE INVENTION

According to the invention, an article of luggage or the like comprises first and second generally rectangular side wall elements, the first side wall element spaced from the second, and at least a joining wall element disposed between and joining the first and second side wall elements. The joining wall element has opposite first and second surfaces, and is joined to an inner surface of the first side wall element by the steps of: disposing the joining wall element upon the side wall element, generally along the first edge, with the first surface of the joining wall element in opposed position to the inner surface of the first wall element, the joining wall element having an outer edge, joining the joining wall element to the side wall element along a first joining region adjacent and generally parallel to the first edge of the side wall element, the first joining region spaced on the joining wall element from the outer edge of the joining wall element extending toward the second side wall element, at a region adjacent the second side edge, folding the joining wall element in a manner to dispose the second surface of the joining wall element in opposed position to the inner surface of the side wall element, joining the joining wall element to the side wall element along a second joining region adjacent and generally parallel to the second edge of the side wall element, the second joining region spaced on the joining wall element from the outer edge of the joining wall element, whereby the joining wall element is adapted to extend from connection with the first side wall element adjacent and generally parallel to the first and second side edges.

Preferred embodiments of the invention may include one or more of the following features. The first side wall element comprises a zipper disposed to lie adjacent the inner surface of and generally in a plane parallel to the plane of the first wall element, and generally along the first edge of the first wall element. The joining wall element is joined to the side wall element by stitching, preferably the first joining region and the second joining region comprise .g.ersecting first and second lines of stitching, e.g., disposed generally perpendicular to each other. The joining wall element comprises a zipper, and the outer edge comprises one side of the zipper, or the joining wall element comprises a gusset.

According to another aspect of the invention, an article of luggage or the like formed in part of textile, leather or the like has a corner at the intersection of a first edge and a second edge of each side wall element formed by the steps of: removing a segment of the side wall element at a first corner line intersecting adjacent edges of the side wall element, folding a corner segment, from a second corner line inward of and generally parallel to the first corner line, inwardly upon the side wall element, folding a first edge segment from a first edge line generally parallel to the first edge inwardly upon the side wall element and upon the inwardly folded corner segment, folding a second edge segment from a second edge line generally parallel to the second edge inwardly upon the side wall element and upon the inwardly folded corner segment, and joining the first edge segment to the underlying side wall element and joining the second edge segment to the underlying side wall element, and further includes the improvement wherein: the joining wall element has opposite first and second surfaces, and is joined to an inner surface of a first side wall element by the steps of: disposing the joining wall element upon the side wall element, generally along the first edge, with the first surface of the joining wall element in opposed position to the inner surface of the first wall element, the joining wall element having an outer edge, joining the joining wall element to the side wall element along a first joining region adjacent and generally parallel to the first edge of the side wall element, the first joining region spaced on the joining wall element from the outer edge of the joining wall element, extending toward the second side wall element, at a region adjacent the second side edge, folding the joining wall element in a manner to dispose the second surface of the joining wall element in opposed position to the inner surface of the side wall element, joining the joining wall element to the side wall element along a second joining region adjacent and generally parallel to the second edge of the side wall element, the second joining region spaced on the joining wall element from the outer edge of the joining wall element, whereby the joining wall element is adapted to extend from connection with the first side wall element adjacent and generally parallel to the first and second side edges.

Preferred embodiments of this aspect of the invention may include one or more of the additional features described above and may further include one or more the following features. The first edge line is generally perpendicular to the second edge line, preferably the first edge is spaced from the first edge line by a predetermined distance, and the second edge is spaced from the second edge line by a distance substantially equal to the predetermined distance. The first corner line may also be spaced from the second corner line by a distance substantially equal to the predetermined distance. The first edge segment and the second edge segment are joined to the wall element by stitching, e.g., comprising a first line of stitching adjacent the inwardly folded edges and a second line of stitching adjacent the edge lines. The second corner line is disposed at an angle of about 135° to each of the adjacent first and second edges.

According to another aspect of the invention, an article of luggage or the like comprises first and second generally rectangular side wall elements, the first side wall element spaced from the second, and at least a joining wall element disposed between and joining inner surfaces of the first and second side wall elements, the joining wall element having opposite first and second surfaces generally perpendicular to planes of the first and second side wall elements, the first side wall element further comprising a zipper disposed to lie adjacent the inner surface of and generally in a plane parallel to the plane of the first wall element, and generally along a first edge of the first wall element.

In preferred embodiments of this aspect of the invention, the zipper defines a closure to a pocket of dimensions substantially the same as outer dimensions of the first side wall element. The joining wall element may comprise a second zipper or a gusset.

Other features and advantages of the invention will be apparent from the following description of a presently preferred embodiment, and from the claims.

PREFERRED EMBODIMENT

I first briefly describe the drawings.

FIG. 1 is a perspective view of an article of luggage or the like of the invention, e.g., a briefcase, while

FIG. 3 is a somewhat diagrammatic end view taken on the line 3—3 of FIG. 1 while FIG. 3A is a similar top view taken at the line 3A—3A of FIG. 3;

FIGS. 4 through 6 are somewhat diagrammatic views of the sequence of the method of forming the side wall element for an article of luggage of the invention; and FIGS. 7 and 8 are similar views of the sequence of joining, e.g., a gusset having a zipper to the side wall element of the article of luggage of the invention, while FIG. 8*a* is an end section view taken at the line 8*a*—8*a* of FIG. 8.

Figure 1:
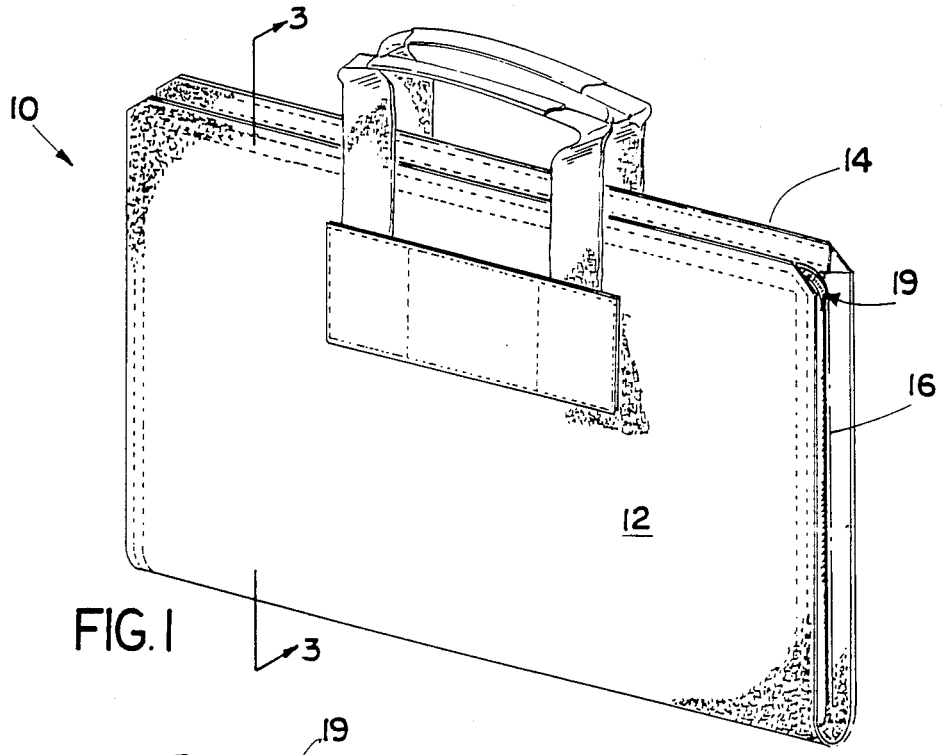
Figure 1A:
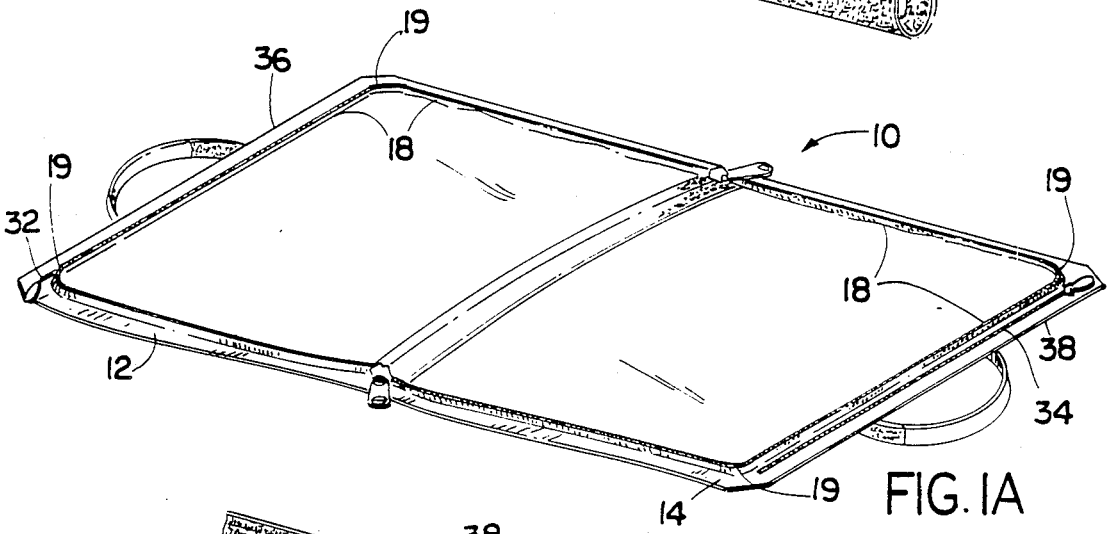
FIG. 1*a* is a similar view of the briefcase of FIG. 1 opened and laid flat.

An article of luggage formed, at least in part of textile, leather or the like, for example, a briefcase 10, has two, spaced apart, generally rectangular side walls 12, 14 joined by a joining wall 16, 17 disposed generally perpendicular to planes $S_1$ and $S_2$ of the side walls. The joining wall forms a gusset, and may include a zipper 18 that extends about three sides of the briefcase to allow it to be opened and laid flat, as in FIG. 1*a*.

The joining wall 16 is attached to the side walls of the briefcase in a manner, to be described below, which provides a smooth corner 19, and provides the advantage of large, separate pockets 20, 22 adjacent the inner surfaces 24, 26 of the side walls 12, 14 of the briefcase, without interrupting the appearance or integrity of the briefcase outer surfaces 28, 30.

Figure 2:
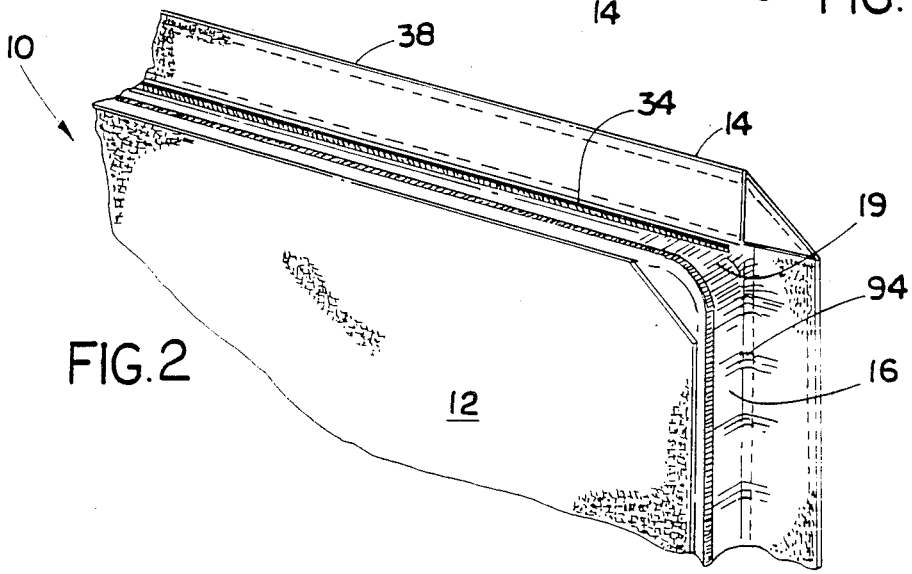
FIG. 2 is an enlarged perspective view of a corner of the briefcase of FIG. 1.

Referring to FIG. 2 and 3, zippers 32, 34 are disposed to lie adjacent the respective inner surfaces 24, 26 of each side wall element 12, 14, generally in planes $Z_1$ and $Z_2$ parallel to the planes $S_1$ and $S_2$, adjacent the upper edges 36, 38 of the side walls. The upper portions 40, 42 of each zipper are joined, e.g., by stitching 44, 46, to the folded flaps 48, 50 of the side wall 12, 14 and the lower portions 52, 54 are joined to the segments 56, 58 of the joining wall 16 and to a liner 60 separating the main compartment 62 from the side pockets 20, 22 by stitching 45, 47. As a result, each side pocket is of dimension similar to that of the briefcase side walls, and is provided without marring or interrupting the outer surfaces 28, 30 of the briefcase.

In the preferred embodiment, the side wall elements have corners of the type shown, formed as will now be described. Referring to FIG. 4, a generally rectangular side wall preform 63 is cut along first corner line 64 at an angle of about 135° to the top and side edges 66, 68 to remove a first corner segment 70. A second corner segment 72 is folded at second corner line 74, generally parallel to the first corner line 64, inwardly upon the inner surface 26 of side wall preform (FIG. 5). A first edge segment 76 is folded from a first edge line 38 generally parallel to the first edge 78 inwardly upon the inner surface 26 of side wall element preform 63 and upon the inwardly folded corner segment 72. A second edge segment 80 is then folded from a second edge line 82 generally parallel to the second edge 84 inwardly upon the surface 26 of the side wall element preform and also upon the inwardly folded corner segment 72. The first and second edge segments 76, 80 may then be joined to the underlying side wall element, e.g., by stitching 71. Where desired, e.g., in the embodiment of FIG. 1 et seq., the zipper 34 for forming the large side pocket 22 of the invention may be disposed with a first upper portion 42 beneath the first edge segment 76, and secured thereto, e.g., by stitching 46.

Referring now to FIGS. 7, 8 and 8*a*, for joining the joining wall 16 to the side wall 14, the joining wall element has opposite first and second surfaces 86, 88, and is joined to an inner surface 26 of a first side wall element (FIG. 7 and 8) or to the lower portion 52 of the side pocket zipper 34 (FIGS. 1 et seq.) by the following steps.

Portion 58 of the joining wall element 16 is disposed upon the side wall element, generally along the first edge 38, with the first surface 86 of the joining wall element in opposition to the inner surface 26 of the first wall element. The joining wall element is attached to the first side wall element (or to the lower zipper portion) along a first joining region 90 adjacent and generally parallel to the first edge 38 of the side wall element, the first joining region spaced on the joining wall element from the outer edge 92 of the joining wall element, i.e., extending toward the inner surface 24 of the second side wall element 12. At a region 96 adjacent the second side edge 82, the joining wall element is folded in a manner to form a smooth corner 19 and to dispose the second surface 88 of the joining wall element in opposition to the inner surface 26 of the side wall element. The joining wall element is joined to the side wall element along a second joining region 94 adjacent and generally parallel to the second edge 82 of the side wall element, the second joining region is also spaced on the joining wall element from the outer edge 92 of the joining wall element. As a result (referring to FIG. 8*a*), the joining wall element extends from connection 94 (and 90) with the side wall element 14 adjacent and generally parallel to the side edge 82 (and 38), and perpendicular to the plane, $S_2$, of the side wall 14.

Other embodiments are within the following claims. For example, edge 78 is spaced from line 38 by a predetermined dimension, which is equal to the distance between edge 84 and line 82, and between edge 64 and line 74, and stitching lines 90, 94 are continuous, and disposed perpendicular to each other.

What is claimed is:

1. A stitched case comprising a first generally rectangular side wall element, a second generally rectangular side wall element, the first side wall element being spaced from the second side wall element, and at least a joining wall element disposed between and joining said first and second side wall elements, said joining wall element having opposite first and second surfaces, and being joined to an inner surface of a first side wall element by the steps of:

disposing said joining wall element upon said first side wall element, generally along a first edge of said first side wall element, with the first surface of said joining wall element in opposition to the inner surface of said first side wall element, said joining wall element having an outer edge, joining said joining wall element to said first side wall element along a first joining region adjacent and generally parallel to the first edge of said first side wall element, said first joining region spaced on said joining wall element from the outer edge of said joining wall element extending toward said second side wall element, at a region adjacent a second edge of said first side wall element, folding said joining wall element in a manner to dispose the second surface of said joining wall element in opposition to the inner surface of said first side wall element, joining said joining wall element to said first side wall element along a second joining region adjacent and generally parallel to the second edge of said first side wall element, said second joining region spaced on said joining wall element from said outer edge of said joining wall element, whereby said joining wall element is adapted to extend from connection with said first side wall element adjacent and generally parallel to said first and second edges.

2. The stitched case of claim 1 wherein said first side wall element comprises a zipper disposed to lie generally in a plane parallel to a plane of the inner surface of said first side wall element, and generally along said first edge of said first wall element.

3. The stitched case of claim 1 or 2 wherein said joining wall element is joined to said first side wall element by stitching.

4. The stitched case of claim 3 wherein said first joining region and said second joining region comprise intersecting first and second lines of stitching.

5. The stitched case of claim 4 wherein said first and second lines of stitching are disposed generally perpendicular to each other.

6. The stitched case of claim 1 or 2 wherein said joining wall element comprises a zipper, and said outer edge comprises one side of said zipper.

7. The stitched case of claim 1 or 2 wherein said joining wall element comprises a gusset.

8. In a stitched case comprising a first generally rectangular side wall element, a second generally rectangular side wall element, the first side wall element being spaced from the second side wall element, and at least a joining wall element disposed between and joining said first and second side wall elements, a corner at the intersection of a first edge and a second edge of each said side wall element is formed by the steps of:

removing a segment of said side wall element at a first corner line intersecting adjacent first and second edges of said side wall element, folding a corner segment, from a second corner line inward of and generally parallel to said first corner line, inwardly upon said side wall element, folding a first edge segment from a first edge line generally parallel to said first edge inwardly upon said side wall element and upon the inwardly folded corner segment, folding a second edge segment from a second edge line generally parallel to said second edge inwardly upon said side wall element and upon the inwardly folded corner segment, and joining said first edge segment to the underlying side wall element and joining said second edge segment to said underlying side wall element, the improvement wherein:

the joining wall element has opposite first and second surfaces, and is joined to an inner surface of a first side wall element by the steps of:

disposing said joining wall element upon said first side wall element, generally along said first edge, with the first surface of said joining wall element in opposition to the inner surface of said first side wall element, said joining wall element having an outer edge, joining said joining wall element to said first side wall element along a first joining region adjacent and generally parallel to the first edge of said side wall element, said first joining region spaced on said joining wall element from the outer edge of said joining wall element, and extending toward said second side wall element, at a region adjacent said second side edge, folding said joining wall element in a manner to dispose the second surface of said joining wall element in opposition to the inner surface of said side wall element, joining said joining wall element to said first side wall element along a second joining region adjacent and generally parallel to the second edge of said side wall element, said second joining region spaced on said joining wall element from said outer edge of said joining wall element, whereby said joining wall element is adapted to extend from connection with said first side wall element adjacent and generally parallel to said first and second side edges.

9. The stitched case of claim 8 wherein said first side wall element comprises a zipper disposed to lie generally in a plane parallel to a plane of the inner surface of said first side wall element, and generally along said first edge of said first side wall element.

10. The stitched case of claim 8 or 9 wherein said joining wall element is joined to said first side wall element by stitching.

11. The stitched case of claim 10 wherein said first joining region and said second joining region comprise intersecting first and second lines of stitching.

12. The stitched case of claim 11 wherein said first and second lines of stitching are disposed generally perpendicular to each other.

13. The stitched case of claim 8 or 9 wherein said joining wall element comprises a zipper, and said outer edge comprises one side of said zipper.

14. The stitched case of claim 8 or 9 wherein said joining wall element comprises a gusset.

15. The stitched case of claim 8 or 9 wherein said first edge line is generally perpendicular to said second edge line.

16. The stitched case of claim 15 wherein said first edge is spaced from said first edge line by a predetermined distance, and said second edge is spaced from said second edge line by a distance substantially equal to said predetermined distance.

17. The stitched case of claim 16 wherein said first corner line is spaced from said second corner line by a distance substantially equal to said predetermined distance.

18. The stitched case of claim 8 or 9 wherein said first edge segment and said second edge segment are joined to said side wall element by stitching.

19. The stitched case of claim 18 wherein said stitching comprises a first line of stitching adjacent the inwardly folded edges and a second line of stitching adjacent said edge lines.

20. The stitched case of claim 8 or 9 wherein said second corner line is disposed at an angle of about 135° to each of the adjacent said first and second edge lines.

21. A stitched case comprising a first generally rectangular side wall element, a second generally rectangular side wall element, the first side wall element being spaced from the second side wall element, and at least a joining wall element disposed between and joining inner surfaces of said first and second side wall elements, said joining wall element having opposite first and second surfaces generally perpendicular to planes of said first and second side wall elements, said first and second side wall elements and said joining wall element defining an enclosed space within said case, said enclosed space bounded generally by portions of the inner surfaces of the side wall elements and the first, inner surface of the joining wall element, said first side wall element further comprising a zipper disposed to lie adjacent the inner surface of and generally in a plane parallel to the plane of said side wall element, and generally along a first edge of said first side wall element, between said first edge and intersection of said first side wall element with said joining wall element, said zipper exposed external of the enclosed space defined with said case.

22. The stitched case of claim 21 wherein said zipper defines a closure to a pocket of dimensions substantially the same as outer dimensions of said first side wall element.

23. The stitched case of claim 21 wherein said joining wall element comprises a second zipper.

24. The stitched case of claim 21 wherein said joining wall element comprises a gusset.

* * * * *